United States Patent [19]

Fehler et al.

[11] 4,133,633

[45] Jan. 9, 1979

[54] COMBUSTION CHAMBER FOR GAS TURBINE ENGINES

[75] Inventors: Adolf Fehler, Pfaffing; Günter Kappler, Freising; Günter Kirschey; Jost Schmidt, both of Munich, all of Fed. Rep. of Germany

[73] Assignee: Motoren-und Turbinen-Union Munchen GmbH, Munich, Fed. Rep. of Germany

[21] Appl. No.: 770,976

[22] Filed: Feb. 22, 1977

[30] Foreign Application Priority Data

Feb. 19, 1976 [DE] Fed. Rep. of Germany ..... 2606704

[51] Int. Cl.[2] ..... F23D 15/02; F02C 7/22

[52] U.S. Cl. ..... 431/352; 60/39.74 R; 60/39.65

[58] Field of Search ..... 431/351, 352, 353; 60/39.65, 39.74 R; 138/40, 41, 42

[56] References Cited

U.S. PATENT DOCUMENTS

| | | | |
|---|---|---|---|
| 3,027,746 | 3/1962 | Kappel | 138/40 |
| 3,968,644 | 7/1976 | Fehler | 431/352 |
| 3,989,445 | 11/1976 | Kojima | 431/344 |
| 4,036,528 | 9/1977 | Fehler et al. | 431/352 |

*Primary Examiner*—Henry C. Yuen
*Attorney, Agent, or Firm*—Alan H. Levine

[57] ABSTRACT

A combustion chamber including an outer casing having a flame tube within it defining an annular space between them which receives air from the engine compressor. The flame tube has diametrically opposed pairs of air inlet ports through which air from the annular space flows substantially radially into the flame tube. A flow guide on the exterior of the flame tube is associated with each air inlet port. The upstream end of each flow guide is open to air from the compressor and the downstream end extends inwardly and downstream and partitions the upstream portion of its respective air inlet port from the annular space. A fuel tube extends into each flow guide. A curved baffle may extend radially inwardly at each air inlet port and define an arcuate louver between the baffle and the downstream edge of its respective air inlet port. Each air inlet port may have a square upstream portion merging into a circular downstream portion. A porous metering member may be provided in each fuel tube along with a flow restrictor.

14 Claims, 4 Drawing Figures

FIG. 3
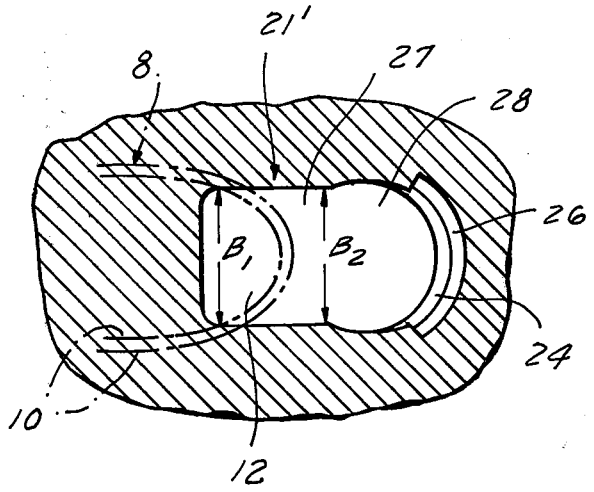
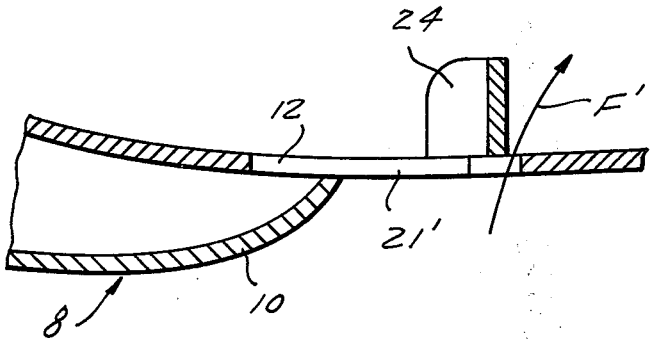
FIG. 4

COMBUSTION CHAMBER FOR GAS TURBINE ENGINES

This invention relates to a combustion chamber for gas turbine engines. The combustion chamber consists of an outer casing and at least one flame tube therein which is energized with primary air and with mixing air from an annulus formed between it and the outer casing. The flame tube has in its upstream area several pairs of diametrically opposed air admission ports each associated with a fuel tube for the simultaneous admission of fuel to the primary air portion. The rear wall of the flame tube, when viewed in radial section, has an essentially semicircular, outwardly vaulted shape.

In conventional constructions of combustion chambers for gas turbine engines, the fuel is atomized under great pressure as it passes through so-called simplex or duplex nozzles. The fuel is injected into the primary zone where it is conditioned, or vaporized, for combustion. Alternatively, the fuel is introduced into the primary zone through air-operated atomizer nozzles, where as a rule, air is admixed with the fuel while still in the nozzle to hasten the conditioning process.

Another known practice of fuel introduction and conditioning is that of using various types of so-called vaporizer burners, in which the fuel attains a gaseous stage and mixes with air owing to the high wall temperature resulting from combustion and to the flow conditions in the burner. The vaporizer burners often come with tubular vaporizers taking the shape of a letter T or of a hook.

An essential disadvantage encumbering the known vaporizer burners is that the tubular vaporizers occupy much room within the combustion chamber but still have only relatively little surface area for fuel vaporization, and as a result no more than 8 or 10 percent of the fuel admitted is actually vaporized.

Such fuel injection and conditioning systems have a further disadvantage in that combustion largely originates at one point, so that uniform exit temperature profiles are attained only by controlling the mixing process with a great deal of engineering paraphernalia. This type of one-point fuel injection further calls for relatively long combustion chambers for three-dimensionally uniform fuel conditioning and, thus, uniform combustion. Alternatively, it necessitates unduly pronounced primary zone swirls of fuel and air and the attendant high pressure and, thus, performance losses, to achieve relatively uniform combustion in the primary zone.

A combustion chamber of this generic category disclosed in U.S. Pat. No. 3,968,644, attempts to eliminate disadvantages associated with fuel admission and conditioning means of the combustion chambers. This is done especially by improving the conditioning process for the fuel-air mixture to achieve combustion with a minimum of injurious matter, and by achieving a uniform temperature profile at the combustion chamber exit while occupying a minimum of space or length within the combustion chamber. A further advantage claimed for the invention described in U.S. Pat. No. 3,968,644 is that it will permit the input to the combustion chamber to be increased.

Summarized below are the most significant characteristics of the invention described in U.S. Pat. No. 3,968,644 in explanation of the above-outlined problem area:

The air admission ports are arranged immediately downstream of the rear wall of the flame tube, in the lateral wall sections of the flame tube, and the outlets of the fuel tubes open into the respective air admission ports slightly behind that wall section of each air admission tube which is nearest the rear wall of the flame tube. Then, in accordance with U.S. Pat. No. 3,968,644, when the high-speed jets of air meet, since they are directed one towards the other, they form primary zone swirls which recirculate from the approximate center of the flame tube towards the rear wall of the flame tube. The relatively low-pressure or nearly unpressurized fuel is imbedded and mixed with the swirling primary air. The remaining portions of the air jets directed toward one another are deflected in the center area of the flame tube in the direction of the main stream for use as mixing air, where the air jets are assumed to attain a relatively great velocity of maximally 50 m/sec if not a little more.

In a broad aspect, the present invention provides an improvement on the combustion chamber coming within the problem area cited in U.S. Pat. No. 3,968,644.

It is a particular object of the present invention to provide a combustion chamber of the generic category provided with flow guides arranged laterally on the upstream wall of the flame tube. The flow guides are open to the compressor air flow and essentially extend in the long direction of the combustion chamber. The outer wall sections of the guides are bent towards the center of the chamber, to cover the upstream end of the air admission ports arranged immediately behind the rear wall of the flame tube, and to provide the flow guides with flow sections which lead to the interior of the flame tube and are screened off from the compressor air flow in the annulus, where a separate fuel metering tube projects into each flow guide.

The combustion chamber of the present invention offers the advantages that accurately defined fuel-air contents per inlet area of the flame tube are provided as early as the entry to the flame tube, and that the respective fuel-air contents are intensively mixed and conditioned before they reach the combustion zone in the flame tube.

When compared with the combustion chamber disclosed in U.S. Pat. No. 3,968,644, the conditioning zone for the respective, metered fuel-air contents is considerably extended to promote homogeneous combustion and a maximum absence of injurious matter.

A further advantage provided by the present invention is that the relatively long conditioning zone is achieved in the absence of additional structural provisions within the flame tube. The flow guides provided for the purpose do not appreciably complicate the design, and their arrangement laterally outside on the vaulted rear wall of the flame tube does not necessitate a radially wider combustion chamber.

Further objects and advantages of the present invention will become apparent from the following detailed description read in the light of the accompanying drawings, in which:

FIG. 3 is an enlarged fragmentary view of the combustion chamber looking in the direction of arrow X of FIG. 2; and FIG. 4 is an enlarged elevational detail view of FIG. 3.

Figure 1:
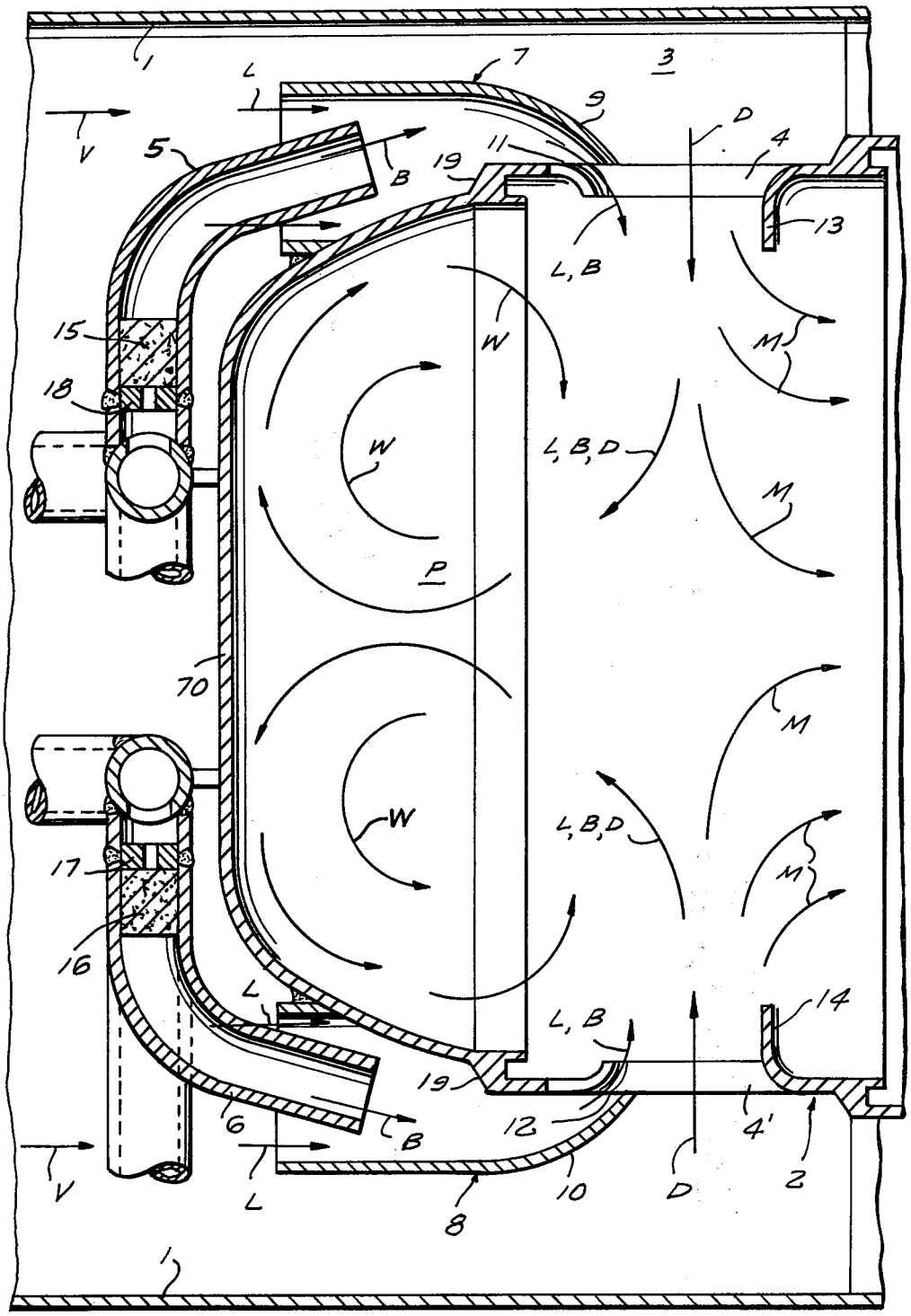
FIG. 1 is an elevational view illustrating a first embodiment of a combustion chamber section essentially comprising the entire combustion zone and arranged in accordance with the present invention.

With reference now to FIG. 1 the combustion chamber consists of an outer casing 1 and a flame tube 2 arranged therein. The flame tube is pressurized with primary and secondary air from an annulus 3 formed between the flame tube 2 and the outer casing 1.

In its upstream area the flame tube 2 has several diametrically opposed pairs of air admission ports 4, 4' arranged around the periphery of the flame tube. Each air admission port 4, 4' is associated with a fuel tube 5, 6, respectively, for the simultaneous admission of fuel B to a first primary air portion L. The rear wall 70 of the flame tube when viewed in radial section has an essentially semicircular, outwardly vaulted shape.

Arranged laterally on the rear wall 70 of the flame tube are flow guides 7, 8 which are open to compresor air V and essentially extend in the long direction of the combustion chamber. The outer wall sections 9, 10 of the flow guides are bent towards the center of the flame tube to cover the upstream portions of air admission ports 4, 4'. The outer wall sections 9, 10 thus provide inlet flow areas 11, 12 for the flow guides 7, 8 towards the interior of the flame tube, these flow areas being screened off from compressor air flow V in annulus 3.

Projecting into each flow guide 7, 8 is a separate fuel tube 5, 6, respectively. For intensive mixing, considering the position of the inlet flow areas 11, 12, of the fuel B with the respective first primary air portion L, the fuel tubes 5, 6 are arranged at an angle with the outer wall sections 9, 10 of the flow guides 7, 8, these outer wall sections essentially extending parallel to the longitudinal centerline of the combustion chamber.

The flow guides 7, 8 are arranged and shaped such that the mixture formed therein of fuel-air contents B, L is increasingly accelerated as the duct narrows in the direction of the respective inlet flow area 11, 12, so that the drag-along effect of the primary air portion L relative to the fuel contents B is augmented. The augmented velocity achieved, inside the flow guides 7, 8, by the fuel-air contents B, L is of advantage with a view to the stable flame needed in primary zone P and to uniform propagation of the flame.

The arrangement and the shape of the flow guides 7, 8 and of the fuel tubes 5, 6 make it possible to admit the smallest amounts of fuel at a velocity $\leqq$ 1 m/sec uniformly together with the first primary air portion L through inlet flow areas 11, 12 in the side walls of flame tube 2 and into the combustion zone. Each inlet flow area 11, 12 is screened off from annulus 3 by means of outer wall sections 9, 10. Before entering flame tube 2, fuel B mixes intensively with the incoming first primary air portion L. The relatively great velocity of the fuel-air mixture L, B when entering the combustion zone also prevents ignition of the gas mixture outside the combustion chamber.

The fuel-air mixture admitted through inlet flow area 11, 12 encounters, at a relatively small angle, the air jets D entering at relatively great velocity through air admission ports 4, 4' radially towards the center of the combustion chamber. The air jets D meeting in approximately the center of the flame tube in part drag along the fuel-air mixture (arrows L, B, D) and thus provide primary zone swirls W consisting of an intimately conditioned fuel-air mixture and ensuring the intended long conditioning zone. The remaining part of the air jets D, directed one against the other, form mixing air portions M which flow downstream to achieve uniform distribution of the temperature over the entire cross section of the flame tube.

The second primary air portion, which is substantially greater than the first primary air portion L and serves to stabilize the flame, is thus provided by the portion of the air jets D which are deflected in the direction of the rear wall 70 of the flame tube. The primary zone whirls W virtually fill the primary zone P which essentially extends within the rear wall 70 of the flame tube, to prevent fuel residues from carbonizing on the rear wall 70 of the flame tube and, thus, formation of soot.

As will also be seen from FIG. 1 the air admission ports 4, 4' are associated at the downstream ends with baffles 13, 14 which are directed radially counter to the main flow in flame tube 2. The baffles are intended to assist the creation of the flow pattern shown in flame tube 2 by directing the air jets towards the center of the combustion chamber, whereby the air is accurately divided into the portions needed for primary air and mixing air (arrowheads D), respectively.

To meter the fuel under practically no pressure and in a uniform distribution, the fuel tubes 5, 6 incorporate members 15, 16 made of a porous, or sintered, highly heat and corrosion resistant material. The members 15, 16 may also be nickel-chromium alloy metallic sponge. Flow restrictors 17, 18, such as an apertured diaphragm, may be provided upstream of the members 15, 16, respectively.

To intensify the mixing of the fuel with the air within the flow guides 7, 8, the fuel tubes 5, 6 are arranged at an angle with the primary air flow (arrows L) or with the outer wall sections 9, 10. The intensity of fuel-air conditioning is assisted by the outer edge of the flame tube being directed against the direction of flow.

Employing the same references for essentially the same details of FIG. 1, FIGS. 2–4 illustrate a combustion chamber where the air admission ports 21, 21', arranged immediately adjacent the rear wall 20 of the flame tube, are associated with baffles 23, 24. The baffles extend near the downstream edge of their respective ports, and project radially inwardly into the flame tube. The baffles are curved about a centerline extending radially of the flame tube such that an air louver 25, 26 in the shape of an arc is formed between the port edge and the curved baffle.

As may be seen more clearly in FIG. 3, the air admission ports, such as 21' of the flame tube 22, may change shape, in the direction of the main flow in the combustion chamber, from a square flow area 27 to a circular flow area 28. About two-thirds of the square flow area 27 is covered by the respective inwardly curved end section of the outer wall 10 of the flow guide 8. It may then be helpful to make the square flow area 27 where it changes ($B_2$) into a circular flow area 28 as wide or wider than the original dimension ($B_1$), so that $B_2 \geqq B_1$.

The air flowing into flame tube 2 (arrowheads F, F') through the segment louvers 25, 26 downstream of the baffles 23, 24 serves to eliminate turbulence if arising downstream of the baffles 23, 24 to maintain the flow pattern (arrows L, B, D. W and M of FIG. 1) needed for homogeneous combustion.

The essential advantage provided by the arrangement of FIG. 3 and FIG. 4 resides in the fact that the fuel B introduced into the flow guides 7, 8 is not deflected in the direction of the marginal zone of the respective inflow area 11 or 12 nor in the direction of the respective square section, such as 27 in FIG. 3. As a result, fuel particles are definitely prevented from mingling with the mixing air portion M on their way downstream.

Figure 2:
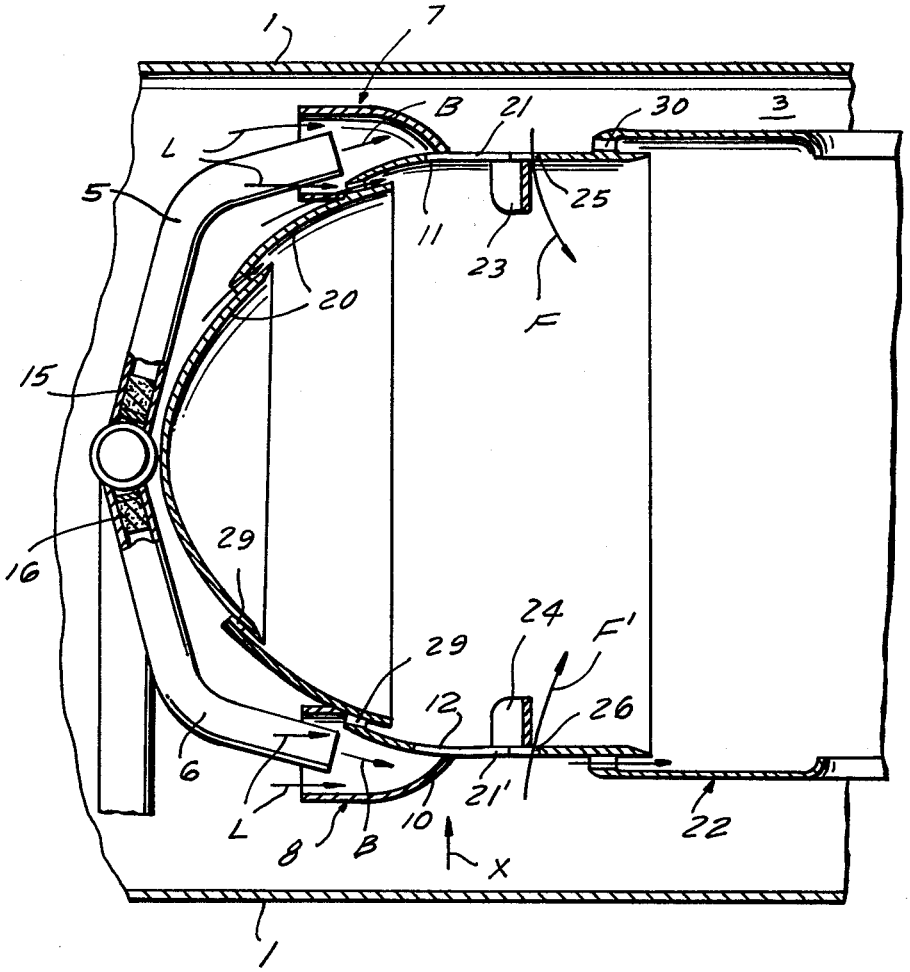
FIG. 2 is an elevational view illustrating an alternative embodiment of the combustion chamber section essentially comprising the entire combustion zone.

The embodiment of FIG. 2 differs from that of FIG. 1 in that the rear wall 20 of the flame tube, as well as the lateral walls of the flame tube 22 incorporate a plurality of louvers 29 and 30 for effectively cooling the flame tube 22 and for preventing undesirable decelerations in the flow of the fuel-air mixture or in the combustion gases in the region near the wall 20 of flame tube 22.

The pattern of flow illustrated in detail in the flame tube of FIG. 1 (arrowheads D; L, B, D; W; and M) analogously applies also to FIG. 2.

The embodiments in FIGS. 1 and 2 constitute can and annular type combustion chambers, respectively. The inventive concept embraces also other types of combustion chamber, such as canannular combustion chambers, where the outer combustion chamber casing extends co-axially with the longitudinal centerline of a gas turbine engine and where a plurality of flame tubes are equally spaced within the outer casing. The inventive concept also embraces straight annular combustion chambers.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A combustion chamber for a gas turbine engine having an air compressor, comprising:

(a) an outer casing, (b) a flame tube within said casing defining an annular space between said tube and casing, said space receiving air from the engine compressor, said flame tube having a back wall at its upstream end, (c) a plurality of diametrically opposed pairs of air inlet ports in said flame tube near its upstream end through which air from said annular space is introduced generally radially inwardly into said flame tube.

(d) a separate flow guide associated with each air inlet port, said flow guides being carried on the exterior surface of said flame tube, each flow guide extending generally in the longitudinal direction of the combustion chamber, the upstream end of each flow guide being open to air from the engine compressor and the downstream end of each guide extending toward the longitudinal centerline of the combustion chamber and partitioning the upstream portion of its respective air inlet port from said annular space, and (e) a separate fuel tube for introducing fuel into each of said flow guides, the outlet of each fuel tube being downstream from the back wall of said flame tube but upstream from its respective air inlet port, and the outlet of each fuel tube being arranged to direct fuel toward the inner surface of its respective flow guide.

2. A combustion chamber as defined in claim 1 wherein the downstream end of each flow guide and the upstream portion of its respective air inlet port define between them a fuel-air mixture inlet area through which the fuel-air mixture enters said flame tube at an acute angle to the air entering the flame tube through the remainder of the respective air inlet port.

3. A combustion chamber as defined in claim 1 wherein each fuel tube extends into its respective flow guide at an acute angle to the upstream part of said flow guide.

4. A combustion chamber as defined in claim 1 including a baffle associated with each air inlet port extending radially into said flame tube, said baffle being spaced close to the downstream edge of its respective air inlet port so as to define a louver between said baffle and downstream edge through which air from said annular space enters said flame tube.

5. A combustion chamber as defined in claim 4 wherein said louver is curved around a centerline extending radially of said flame tube, and the downstream edge of its respective air inlet port is similarly curved, whereby said louver has an arcuate shape.

6. A combustion chamber as defined in claim 1 wherein each of said air inlet ports has a substantially square shape at its upstream end merging into a downstream circular shape.

7. A combustion chamber as defined in claim 6 wherein a major portion of the square shaped portion of each air inlet port is covered by the downstream end of its respective flow guide.

8. A combustion chamber as defined in claim 6 wherein the square shaped portion of each air inlet port is as wide or wider at its end which merges ino the circular shaped portion than it is at its upstream end.

9. A combustion chamber as defined in claim 1 including a porous member within each of said fuel tubes for metering fuel through said tube.

10. A combustion chamber as defined in claim 9 wherein said porous member is made of a ceramic material.

11. A combustion chamber as defined in claim 9 wherein said porous member is made of a sintered material.

12. A combustion chamber as defined in claim 9 wherein said porous member is a nickel-chromium alloy metallic sponge.

13. A combustion chamber as defined in claim 9 including a flow restricting means in each fuel tube upstream of said porous member.

14. A combustion chamber as defined in claim 13 wherein said flow restricting means is a diaphragm formed with an aperture.

* * * * *